United States Patent [19]

Takada

[11] 4,073,168

[45] Feb. 14, 1978

[54] DEVICE FOR RELEASABLY LOCKING A CAP ON A CLOSED POSITION

[75] Inventor: Shinichi Takada, Koyama, Japan

[73] Assignee: Kabushiki Kaisha Komatsu Seisakusho, Tokyo, Japan

[21] Appl. No.: 679,778

[22] Filed: Apr. 23, 1976

[30] Foreign Application Priority Data

Oct. 3, 1974 Japan ..... 49-118896

[51] Int. Cl.[2] ..... B65D 55/12; B65D 55/14

[52] U.S. Cl. ..... 70/165; 70/203; 70/218; 220/210; 220/235

[58] Field of Search ..... 70/163, 164, 165, 166, 70/167, 175, 178, 180, 188, 200, 203, 218, 231; 220/210, 214, 322, 235, 236, 237; 215/207

[56] References Cited

U.S. PATENT DOCUMENTS

| | | | |
|---|---|---|---|
| 1,702,205 | 2/1929 | Freedman | 70/165 |
| 1,702,532 | 2/1929 | Boomer et al. | 70/165 X |
| 1,975,178 | 10/1934 | Smith et al. | 70/218 UX |
| 2,566,816 | 9/1951 | Work | 220/235 X |
| 3,391,554 | 7/1968 | Wrenshall | 70/178 |
| 3,477,607 | 11/1969 | Fuzzell et al. | 70/165 X |
| 3,537,283 | 11/1970 | Mross | 70/164 |

*Primary Examiner*—Roy D. Frazier
*Assistant Examiner*—Thomas J. Holko
*Attorney, Agent, or Firm*—Armstrong, Nikaido & Marmelstein

[57] ABSTRACT

A device for use with a cap having a rubber plug which is inserted into the mouth of a container and which can be tightened and loosened by the turn of a lever provided thereto. The device comprises a cap cover loosely but undetachably fitted over the cap so as to enclose its lever, and a pin slidably supported by the cap cover for movement into and out of engagement with the cap lever. The pin can be padlocked out of engagement with the cap lever, so that the cap is loosenable by the manual turn of the cap cover only when the padlock is opened to permit the pin to move into engagement with the cap lever.

3 Claims, 4 Drawing Figures

DEVICE FOR RELEASABLY LOCKING A CAP ON A CLOSED POSITION

BACKGROUND OF THE INVENTION

This invention relates to a device for releasably locking a cap in a closed position on the mouth of a container or receptacle. The container for use with the device of the invention may or may not be a part of some machine or the like and may be employed for holding either gas, liquid, or solid.

The device of the above specified character usually has a cap cover in the form of a hollow, closed-top cylinder adapted to loosely but undetachably cover a cap, which can be tightened and loosened with respect to a container mouth by the turn of a lever provided thereto. This lever can be turned via the cap cover only when, in accordance with the prior art, the latter is itself moved into engagement with the former, with the cap cover being normally locked out of engagement with the lever.

The cap cover of such a device must of necessity be constituted of separate halves, which are riveted together after irremovably installing the cap lever therein. Thus, if the cap cover halves are not united in exact relative positions because of the misalignment of the rivet holes or for some other reason, the cap cover may fail to positively engage the lever in a groove which is formed internally of the cover along the contacting surfaces of its halves. It will then be difficult to properly tighten or loosen the cap by the turn of the cap cover.

SUMMARY OF THE INVENTION

It is therefore an object of this invention to provide a device for releasably locking a cap in a closed position on the mouth of any desired container, such that the above noted difficulties of the prior art are thoroughly overcome.

Another object of the invention is to provide a device of the character specified which is easy of manufacture or assemblage and positive in operation.

The device according to this invention is intended for use with a cap of the type which can be tightened or loosened with respect to a container mouth by the turn of lever means provided thereto. The device comprises a cap cover loosely covering the cap and enclosing its lever means, the cap cover being turnable relative to the cap but incapable of detachment therefrom. A pin is irremovably mounted on the cap cover for sliding movement between a first position, where the pin is held out of engagement with the lever means to permit the cap cover to be turned relative to the cap, and a second position, where the pin engages the lever means to permit the cap to be turned with the cap cover. This pin can be locked in the first position by means such as a padlock. Thus, for tightening or loosening the cap, the pin must be unlocked and hence permitted to move to the second position for engagement with the lever means.

The above and various other objects, features, and advantages of this invention will become more clearly apparent upon consideration of the following description of an illustrative embodiment, with reference had to the accompanying drawings forming a part hereof, wherein like reference numerals refer to like parts throughout.

DESCRIPTION OF THE PREFERRED EMBODIMENT

Figure 1:
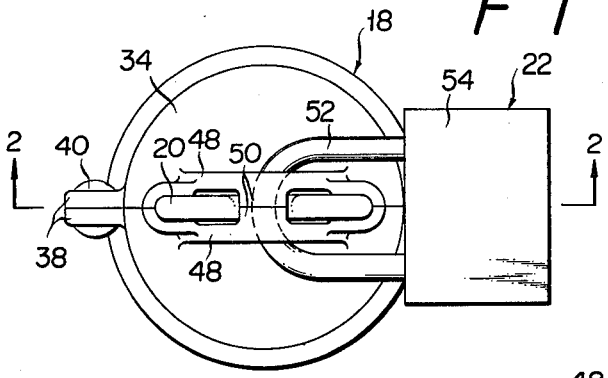
FIG. 1 is a top plan view of the device constructed in accordance with the novel concepts of this invention.
Figure 2:
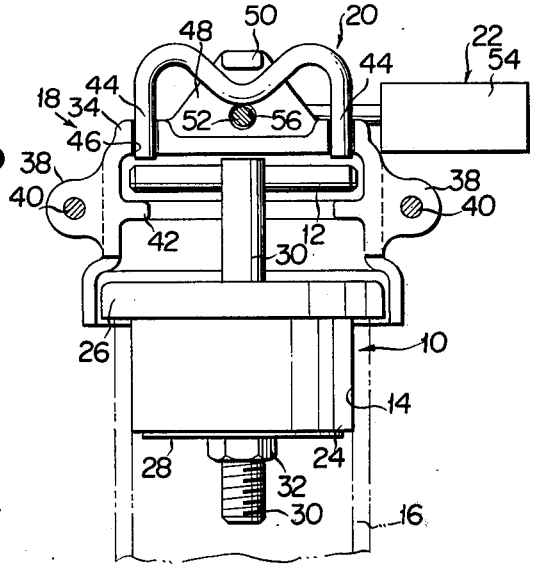
FIG. 2 is a vertical sectional view taken along the line 2—2 on FIG. 1, the view also showing in elevation a cap installed on the mouth of a container and locked by the device of FIG. 1.

With reference to FIGS. 1 and 2 the illustrated embodiment of this invention broadly comprises a cap 10 having a lever 12 for openably closing the mouth 14 of a container 16, a cap cover 18 loosely fitted over the cap, a pin 20 slidably supported by the cap cover for movement into and out of engagement with the lever of the cap, and a padlock 22 for locking the pin out of engagement with the cap lever. The container 16 for use with this invention can be of any desired shape or kind if it has a cylindrical mouth similar to the illustrated mouth 14.

The cap 10, which is conventional and does not, by itself, constitute a feature of this invention, includes a plug or stopper 24 of rubber or like elastic material for insertion into the container mouth 14. This plug 24 is held between top and bottom discs 26 and 28 of rigid material, with the top disc serving to provide a flange on the plug, and a threaded rod 30 extends axially through the plug and the top and bottom discs. The aforesaid lever 12 is secured at its mid-point to the top end of the threaded rod 30 projecting upwardly of the top disc 26, whereas a nut 32 is fitted over the bottom end of the threaded rod projecting downwardly of the bottom disc 28.

Thus, as the cap lever 12 is turned in a predetermined direction, clockwise for example, through means hereinafter described, the threaded rod 30 operates to compress the plug 24 between the top and bottom discs 26 and 28 thereby causing same to increase in diameter. The cap 10 can thus be tightened to close the container mouth 14. The turning of the cap lever 12 in the opposite direction results, of course, in a decrease in diameter of the plug 24, so that the cap 10 can be loosened to open the container mouth 14.

The cap cover 18, forming a part of the device according to the invention, is constituted of exactly identical halves 34 and 36 each integrally provided with a pair of lugs 38 for uniting the cap cover halves by riveting 40. This cap cover is constructed of the separate halves 34 and 36 for undetachably installing the lever 12 therein. To facilitate description, however, this construction will be disregarded, and the cap cover 18 will hereinafter be described as if it were an integral unit.

The cap cover 18 completely encloses the lever 12 of the cap 10 and is internally provided with an annular rib 42 designed to prevent detachment of the cap cover from the cap by engaging the cap lever. It is to be noted that in the condition represented in FIG. 2, the cap cover 18 is free to turn relative to the cap 10.

The pin 20 is substantially in the shape of an inverted W, having opposite end portions 44 arranged in parallel spaced relationship to each other. Arranged over the cap cover 18, the pin 20 has its end portions 44 slidably received in a pair of diametrically opposed holes 46, respectively, that are formed vertically through the top of the cap cover. The pin 20 is movable between a first or raised position shown in FIG. 2 and a second or lowered position shown in FIG. 3.

The cap cover 18 has a pair of lugs 48 extending upwardly therefrom and arranged on opposite sides of the pin 20. These lugs 48 are substantially interconnected at their top ends by projections 50 extending toward each other to provide a stop for limiting the upward motion of the pin 20 relative to the cap cover 18. It will be evident that the lugs 48 with their projections 50 serve also to prevent detachment of the pin 20 from the cap cover 18.

The padlock 22, which can be of conventional make, has a shackle 52 which can be opened and closed with respect to a key-operated lock mechanism 54. The shackle 52 passes through eyes 56 in the lugs 48 of the cap cover 18 for locking the pin 20 in the raised position as best shown in FIG. 2 and thus for holding same out of engagement with the cap lever 12.

Operation

FIGS. 1 and 2 show the cap 10 locked in a closed position on the container mouth 14. For opening this container mouth, a key, not shown, of the padlock 22 may be manipulated in the usual keyhole in the lock mechanism 54 to open the shackle 52. This shackle is then withdrawn out of the eyes 56 in the lugs 48 of the cap cover 18 to permit the pin 20 to drop to the lowered position.

Figure 3:
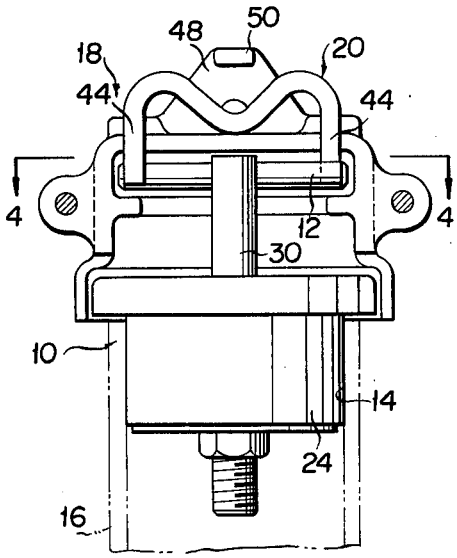
FIG. 3 is a view similar to FIG. 2 but showing the cap ready to be loosened via the device.
Figure 4:
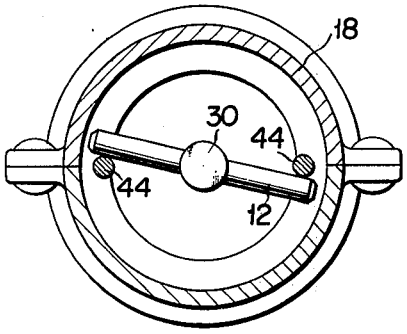
FIG. 4 is a horizontal sectional view taken along the line 4—4 on FIG. 3.

As illustrated in FIGS. 3 and 4, the pin 20 when in the lowered position has its opposite end portions 44 disposed on opposite sides of the cap lever 12. The cap cover 18 with the pin 20 can now be turned manually in the direction opposite to the aforesaid predetermined direction to impart rotation to the threaded rod 30 via the lever 12. The rotation of the threaded rod in the opposite direction results in relative movement of the top and bottom discs 26 and 28 of the cap 10 away from each other, as previously mentioned, so that the plug 24 decreases in diameter. The cap 10 with the cap cover 18 is now removable from the container mouth 14.

For reclosing the container mouth 14, the plug 24 may be inserted therein. Since the pin 20 is now unlocked and is in engagement with the cap lever 12, the manual turn of the cap cover 18 in the predetermined direction results in an increase in diameter of the plug 24. With the cap 10 thus tightened, the pin 20 may be manually lifted to the raised position of FIG. 2, and the open shackle 52 of the padlock 22 is passed through the eyes 56 in the lugs 48 of the cap cover 18 to permit the mid-portion of the pin 20 to rest thereon. As the shackle 52 is subsequently closed, the pin 20 is locked in the raised position, so that the cap 10 cannot be opened unless the unshown key of the padlock 22 is manipulated to open the shackle.

With the invention thus fully described, it is clear that the objects as above stated have been realized in a simple and thoroughly practicable manner. It is understood, however, that the invention itself is not to be limited by the exact details disclosed, as numerous modifications or changes will readily occur to one skilled in the art within the scope of the invention as expressed in the following claims.

What is claimed is:

1. In combination with a cap for openly closing a mouth of a container, wherein the cap has lever means to be turned in either direction relative to the container for tightening or loosening the cap with respect to the mouth, a device for releasably locking the cap in a closed position on the mouth of the container, comprising:

a cap cover loosely fitted over said cap and enclosing said lever means, said cap cover having a pair of lugs extending upwardly therefrom;

means on said cap cover for preventing detachment thereof from said cap while permitting said cap cover to be turned relative to said cap;

a pin slidably supported by said cap cover for movement between a first position, where said pin is held out of engagement with said lever means of said cap to permit said cap cover to be turned relative to said cap, and a second position, where said pin engages said lever means of said cap to permit said cap cover to be turned with said cap; said lugs being arranged on opposite sides of said pin and being substantially interconnected at their top ends to provide stop means on said cap cover for preventing detachment of said pin from said cap cover; and lock means for locking said pin in said first position;

whereby said cap is loosenable via said cap cover only when said lock means is released to move said pin to said second position.

2. The combination of claim 1, wherein said pin is arranged over said cap cover and has opposite end portions slidably extending downwardly therethrough for movement into and out of engagement with said lever means of said cap.

3. The combination of claim 1, wherein said lock means is a padlock having a shackle, and wherein said lugs have eyes through which said shackle of said padlock can be passed, said pin being normally held in said position by resting on said shackle between said lugs.

* * * * *